US009014337B2

(12) United States Patent
Luebcke

(10) Patent No.: US 9,014,337 B2
(45) Date of Patent: Apr. 21, 2015

(54) ROTARY-ANODE X-RAY TUBE WITH REDUCED RADIAL SEALING

(75) Inventor: Michael Luebcke, Hamburg (DE)

(73) Assignee: Koninklijke Philips N.V., Eindhoven (NL)

( * ) Notice: Subject to any disclaimer, the term of this patent is extended or adjusted under 35 U.S.C. 154(b) by 243 days.

(21) Appl. No.: 13/640,501

(22) PCT Filed: Apr. 7, 2011

(86) PCT No.: PCT/IB2011/051499

§ 371 (c)(1),
(2), (4) Date: Oct. 11, 2012

(87) PCT Pub. No.: WO2011/128816

PCT Pub. Date: Oct. 20, 2011

(65) Prior Publication Data

US 2013/0034214 A1 Feb. 7, 2013

(30) Foreign Application Priority Data

Apr. 12, 2010 (EP) ..... 10159652

(51) Int. Cl.
*H01J 35/00* (2006.01)
*H01J 35/10* (2006.01)

(52) U.S. Cl.
CPC ..... *H01J 35/101* (2013.01); *H01J 2235/106* (2013.01)

(58) Field of Classification Search
CPC ... H01J 2235/106; H01J 35/101; F16C 17/10; F16C 17/107
USPC ..... 378/132, 133
See application file for complete search history.

(56) References Cited

U.S. PATENT DOCUMENTS

| | | | |
|---|---|---|---|
| 5,077,775 | A | 12/1991 | Vetter |
| 6,064,719 | A | 5/2000 | Vetter et al. |
| 2005/0089144 | A1 | 4/2005 | Fukushima et al. |

FOREIGN PATENT DOCUMENTS

| | | | |
|---|---|---|---|
| DE | 3505048 | | 8/1986 |
| JP | 03230460 | A | 10/1991 |
| JP | 1196949 | A | 4/1999 |
| JP | 2003217491 | A | 7/2003 |

*Primary Examiner* — Michael Maskell

(57) ABSTRACT

The invention relates to a rotary-anode X-ray tube which includes a sleeve bearing having an axial bearing section and a radial bearing section. Furthermore, radial sealing sections (601, 602) are provided in an outer bearing member (605, 607, 608) which have no functional relation to the axial bearing surfaces (2012) of the axial bearing section. Thus, additional sealing principles like gaskets or sealing edges can be used although this may result in degradation of surface parallelism.

9 Claims, 3 Drawing Sheets

ROTARY-ANODE X-RAY TUBE WITH REDUCED RADIAL SEALING

FIELD OF THE INVENTION

The present invention relates to a rotary-anode X-ray tube. In particular, the invention relates to a rotary-anode X-ray tube comprising a sleeve bearing and to an examination apparatus comprising such a rotary-anode X-ray tube.

BACKGROUND OF THE INVENTION

Spiral groove bearings and rotating anode X-ray tubes designed for rotation frequencies higher than 150 Hz may face lubricant leakage problems at the sealing surfaces of the bearing parts. High centrifugal forces acting on the lubricant and strong mechanical forces acting on the bearing parts may influence the effective tightness against lubricant along the entrance gaps of the sealing. In particular, in the case of spiral groove bearings, the contact surfaces of the rotating bearing parts may have to fulfil the functionality of sealing against lubricant loss and exact positioning of the axial bearing surfaces.

U.S. Pat. No. 5,077,775 discloses a rotary-anode X-ray tube comprising at least two spiral groove bearings.

SUMMARY OF THE INVENTION

It may be desirable to improve a rotary-anode X-ray tube in such a manner that the manufacturing effort is reduced.

The present invention provides for a rotary-anode X-ray tube and an examination apparatus according to the features of the independent claims. Further exemplary embodiments of the invention are stated in the dependent claims.

According to a first aspect of the invention, a rotary-anode X-ray tube is provided, which comprises a sleeve bearing with an inner bearing member and an outer bearing member. Both bearing members have corresponding axial bearing surfaces adapted for taking up axial bearing forces and corresponding radial bearing surfaces which are adapted for taking up radial bearing forces. The outer bearing member encloses the inner bearing member (at least partly) and comprises at least one radial sealing section. This at least one radial sealing section has no functional relation to the axial bearing surfaces.

In other words, all the radial sealing sections of the outer bearing member are adapted and located such that they do not influence the axial bearing function of the sleeve bearing.

According to another aspect of the invention, an examination apparatus for examination of an object of interest is provided, wherein the examination apparatus comprises an above and below described rotary-anode X-ray tube.

According to an exemplary embodiment of the present invention, the examination apparatus is adapted as a medical imaging apparatus.

According to another exemplary embodiment of the present invention, the inner bearing member comprises a tumble disk arrangement with the axial bearing surfaces for taking up the axial bearing forces.

In other words, the inner bearing member comprises a first bearing section with axial bearing surfaces, i.e. the tumble disk arrangement, and a second bearing section with the radial bearing surfaces (i.e. at least one radial bearing surface) for taking up the radial bearing forces. Thus, the radial bearing forces and the axial bearing forces are taken up in different sections of the inner bearing member (and corresponding, separate sections of the outer bearing member).

According to another exemplary embodiment of the present invention, the rotary-anode X-ray tube further comprises a first locking ring and a second locking ring. The first locking ring abuts a bushing element of the outer bearing member at one end in order to provide for a sealing of this end of the sleeve bearing. The second locking ring abuts the bushing element and the other end in order to provide for a sealing of the other end of the sleeve bearing. The two radial sealing sections are located between the first locking ring and the bushing element and between the second locking ring and the bushing element, respectively.

The rotary-anode X-ray tube may comprise no further radial sealing sections.

Furthermore, according to another exemplary embodiment of the present invention, two thrust disks are provided, wherein the two thrust disks are inserted into the bushing element and provide for the axial bearing surfaces.

It may be seen as the gist of the invention to provide a rotary-anode X-ray tube with a sleeve bearing, for example a spiral groove bearing, with axial bearing surfaces which are fixed inside the bushing cylinder without functional relation to radial sealing surfaces. The radial sealing surface design is adapted such that the radial sealing surfaces do not interfere with the axial bearing function.

DETAILED DESCRIPTION OF EMBODIMENTS

Figure 1:
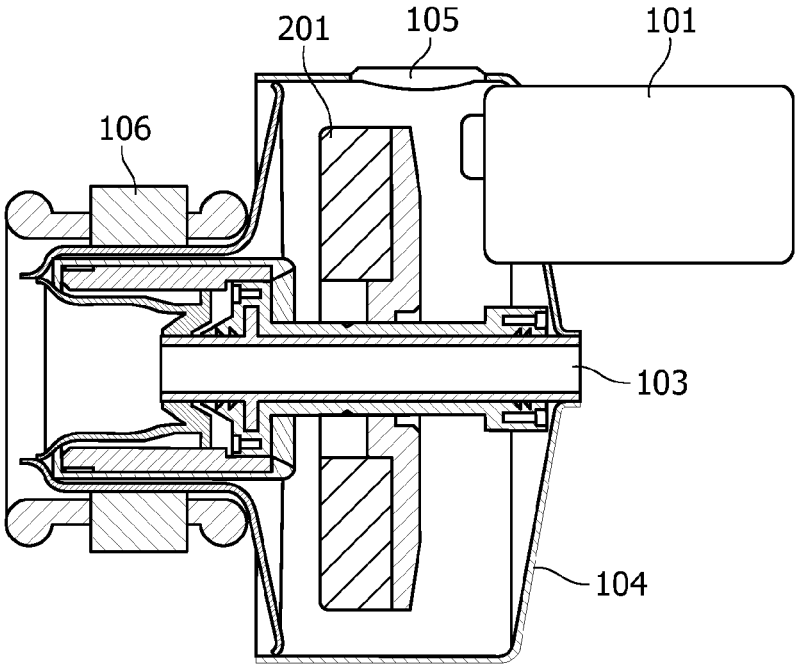
FIG. 1 shows an X-ray tube with a T-shaped spiral groove bearing.

The illustration in the drawings is schematically. In different drawings, similar or identical elements are provided with the same reference numerals.

FIG. 1 shows an X-ray tube with a T-shaped spiral groove bearing of the so-called straddle type. The X-ray tube comprises a cathode assembly 101, an anode disk 201, a spiral groove bearing (straddle design) 103, a metal vacuum envelope 104, an X-ray window 105 and a motor assembly (stator and copper rotor) 106.

The motor assembly 106 drives an outer bearing member which is connected to the rotary-anode 201. Since the contact surfaces of the rotating bearing parts must fulfil the functionality of sealing against lubricant loss and the exact positioning of the axial bearing surfaces, the corresponding movable parts have to be fabricated with high accuracy.

Figure 2:
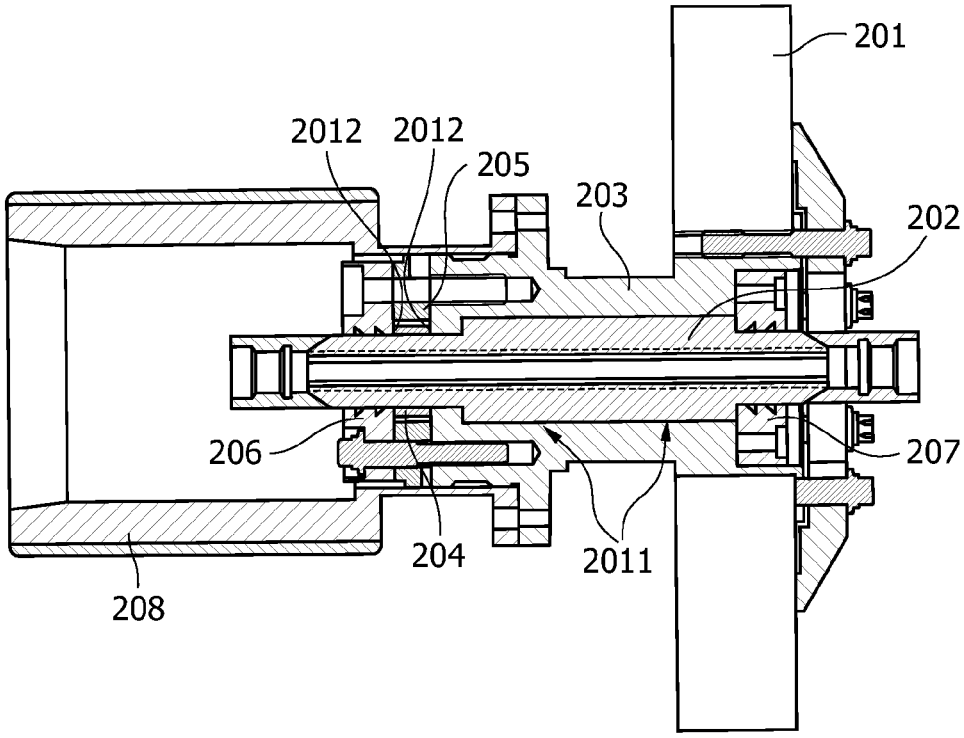
FIG. 2 shows the anode rotation system of an X-ray tube with a tumble disk spiral groove bearing.

FIG. 2 shows the anode rotation system of an X-ray tube with a tumble disk spiral groove bearing of the straddle type which may be adapted according to the invention. Again, reference numeral 201 shows, in a highly schematic manner, the rotary-anode disk. The anode disk 201 is connected to the bushing 203 which is driven by the rotor 208. The bushing 203, which rotates around the bearing shaft 202, has radial bearing surfaces 2011 which take up radial bearing forces.

Furthermore, a tumble disk arrangement 204 is provided which has axial bearing surfaces 2012 for taking up axial bearing forces. Still further, a spacer ring 205 is provided for maintaining a distance between the bushing 203 and the left locking ring 206 arranged at the axial bearing side to realize the required axial bearing gap of the sleeve bearing. On the other side of the bearing shaft 202 is a second locking ring 207 with a sealing function for the bearing lubricant.

As can be seen from FIG. 2, the tumble disk bearing comprises a plurality of radial sealing sections.

Figure 5:
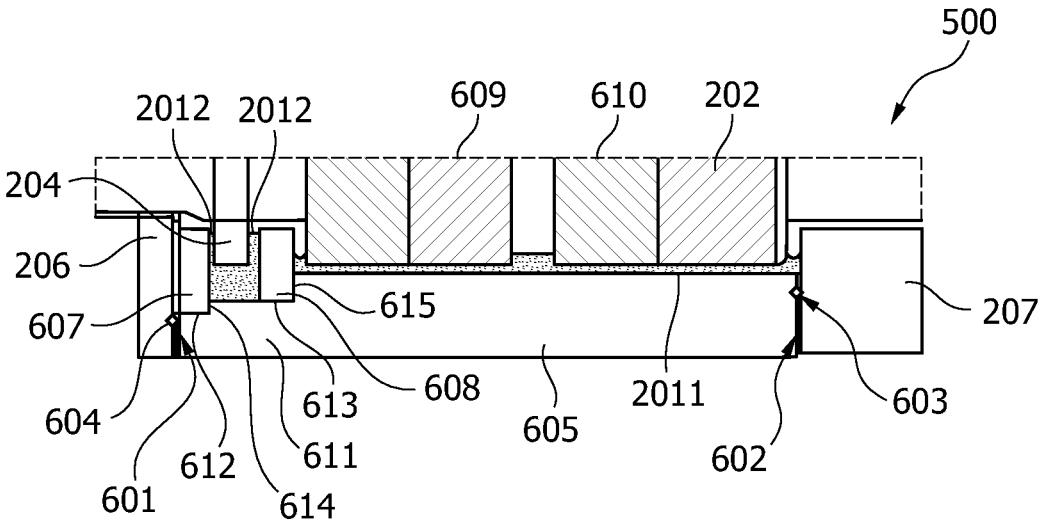
FIG. 5 shows a tumble disk spiral groove bearing according to an exemplary embodiment of the invention.

However, the bearing may also be designed as depicted in FIG. 5.

The left bearing portion which comprises the tumble disk arrangement takes up the axial bearing forces and the right bearing portion takes up the radial bearing forces. The symmetry axis of the tumble disc arrangement can perform a swaying motion about the axis of rotation during rotation of the sleeve bearing.

The cylindrical bearing surfaces in the bearing portions can be manufactured in such a manner that they exhibit hardly any measurable deviations from the exact cylindrical shape and have the specified diameters. Similarly, the axial bearing surfaces may be manufactured in such a manner that hardly any deviations can be detected in respect of plane-parallelism, thickness and smoothness. However, the requirement in respect of right angles between the two bearing surfaces does not have to be satisfied with the same precision, due to the tumble disk arrangement.

Therefore, when the bearing surfaces for the axial and the radial bearing forces do not extend exactly perpendicularly to one another in the outer bearing member, the tumble disc arrangement of the inner bearing member will perform a swaying motion about the axis of rotation during rotation of the sleeve bearing. During this swaying motion the symmetry axis moves around the axis of rotation along a conical surface once per revolution of the sleeve bearing.

The inner bearing member comprises a shaft which has a cylindrical outer surface facing the outer bearing member. The outer side of the shaft may be provided with a pattern of helical grooves and a liquid lubricant, for example a gallium alloy, is provided in the gaps between the inner and outer bearing members in order to constitute a hydrodynamic sleeve bearing which is capable of taking up radial bearing forces.

The tumble disk arrangement 204 can be rigidly connected to a pin and can be tilted out of a perpendicular position relative to the anode shaft through a small angle in any desirable direction. The pin then rolls on its contact point in a corresponding bore in the shaft and the disk will be aligned while requiring a negligibly small force only. The wear thus induced may be reduced to a minimum.

The axial bearing and the radial bearing may have approximately the same outer diameter. In that case, the axial and radial bearing forces will not compete for lubricant because of different centrifugal forces which would cause the bearings to extract lubricant from one another. This may be of importance in case of high rotational speeds.

Figure 3:
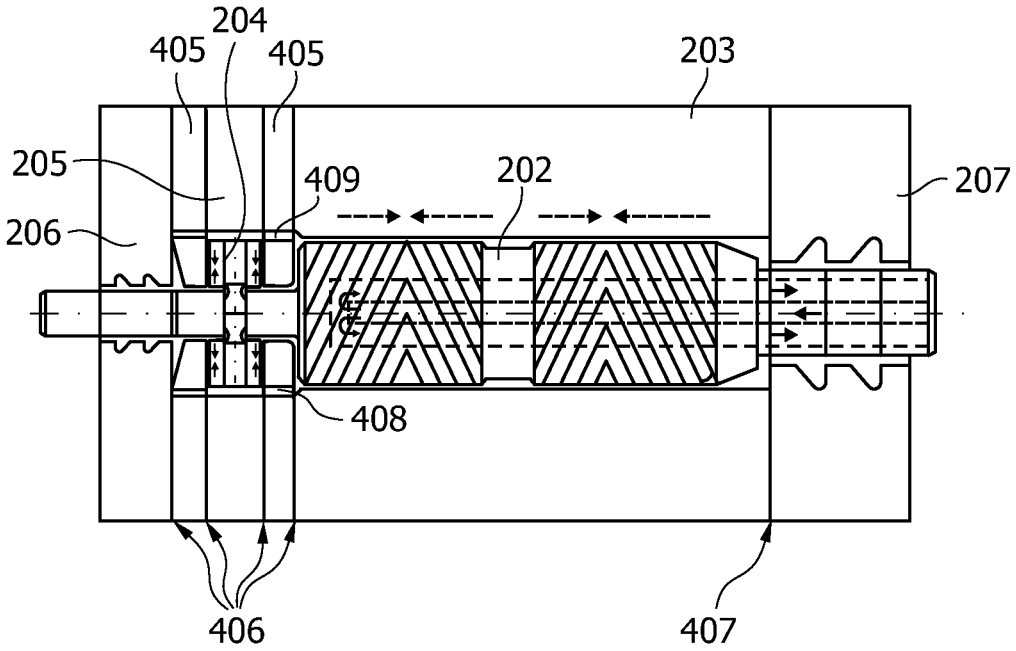
FIG. 3 shows a tumble disk spiral groove bearing.

FIG. 3 shows a tumble disk spiral groove bearing of the straddle type. Reference numeral 406 points to the four radial sealing sections which are exposed to lubricant and which are located in the region of the tumble disk 204.

Reference numeral 407 points to another radial sealing section which may not be exposed to lubricant and which is arranged at the radial bearing side of the bearing.

Two thrust disks 405 are provided on the left side and the right side of the tumble disk arrangement 204. Furthermore, channels or boreholes 408, 409 are provided inside the two thrust disks 405 to provide for a lubricant flow between different sections of the bearing.

Figure 4:
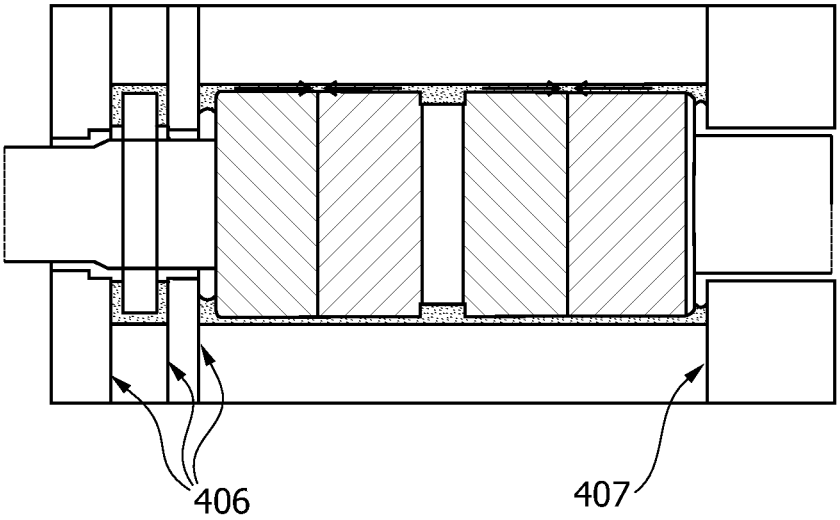
FIG. 4 shows another tumble disk spiral groove bearing.

FIG. 4 shows another tumble disk spiral groove bearing of the straddle type. Again, a plurality of radial sealing sections 406, 407 are provided in the region of the tumble disk bearing and the radial bearing side locking ring, respectively.

FIG. 5 shows a part of a rotary-anode X-ray tube 500 according to an exemplary embodiment of the invention. The inner bearing member comprises two cylindrical bearing surfaces 609, 610 with a pattern of grooves. Furthermore, a tumble disk arrangement 204 is provided having axial bearing surfaces 2012 on either side. The rotary-anode X-ray tube 500 further comprises an outer bearing member (or outer bearing arrangement) 605, 607, 608 to which the two locking rings 206, 207 are connected.

The outer bearing member comprises two thrust discs 607, 608 and a bushing element 605 which is formed in one piece and has a cylindrical inner radial bearing surface 2011 and a section 611 facing the tumble disk arrangement 204 of the inner bearing member 202.

The first locking ring 206 abuts the bushing element 605 at the axial bearing side of the sleeve bearing and the second locking ring 207 abuts the bushing element 605 at the radial bearing side of the sleeve bearing.

It is important to note that the radial sealing sections 601, 602 are located between the first locking ring 206 and the bushing element 605 and between the second locking ring 207 and the bushing element 605, respectively. No further radial sealing sections may exist. In particular, there are no radial sealing sections in the region 611, which is the region in which the tumble disk arrangement 204 is located.

The radial sealing sections 601, 602 can both comprise a respective gasket 604, 603 or another sealing aid which may influence the perpendicularity between 206,207 and 605.

For example, alternatively or additionally, a sealing edge may be provided for radial sealing.

As can be seen from FIG. 5, two thrust disks 607, 608 are inserted into the bushing element 605. The two thrust disks 607, 608 provide for the axial bearing surfaces 2012.

The section 611 facing the tumble disk arrangement 204 of the inner bearing member 202 of the bushing element 605 has a first cylindrical sub-section 612 with a first diameter adapted for receiving the first thrust disk 607 and a second cylindrical sub-section 613 with a second diameter adapted for receiving the second thrust disk 608. The first diameter is bigger than the second diameter and the second diameter is bigger than the diameter of the cylindrical inner radial bearing surface 2011 of the radial bearing.

When the two thrust disks 607, 608 are inserted into the bushing element 605, they are stopped by steps 614, 615, respectively, wherein the first step 614 connects the first cylindrical sub-section with the second cylindrical sub-section and the second step 615 connects the second cylindrical sub-section with the cylindrical inner radial bearing surface.

At least one of the two thrust disks 607, 608 may comprise a thread such that it can be screwed in position.

As an alternative to the first step 614, a distance element or spacer ring can be provided between the two thrust disks.

It should be noted that tumble disk arrangement 204 and the radial bearing surfaces 2011 may have the same diameter.

Figure 6:
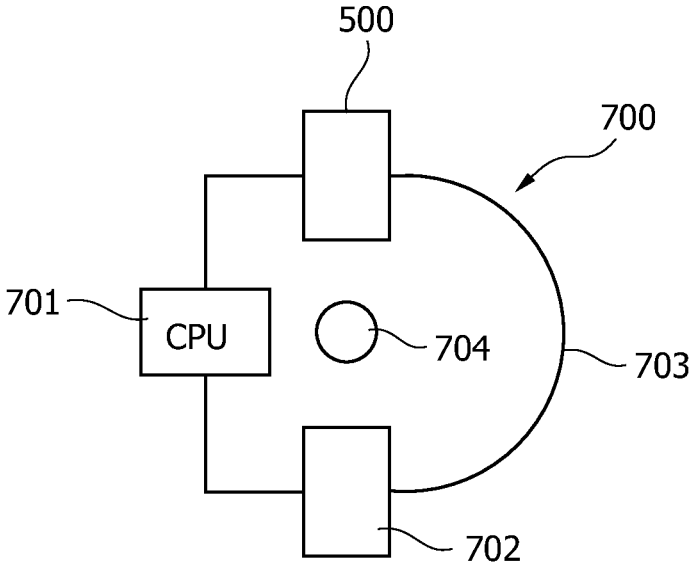
FIG. 6 shows an examination apparatus according to an exemplary embodiment of the present invention.

FIG. 6 shows an examination apparatus which is adapted as a medical imaging apparatus 700. The examination apparatus 700 comprises a rotary-anode X-ray tube 500 and a corresponding detector 702. Between the detector 702 and the rotary-anode X-ray tube 500 is an object of interest 704, for example a patient. Furthermore, a control unit 701 is provided, which is connected to both the anode 500 and the detector unit 702. The detector unit 702 and the rotary-anode X-ray tube 500 are mechanically connected by the connector 703.

The appropriate design and combination of the functional spiral groove bearing surfaces and X-ray tubes can minimize the number of sealing surfaces and the risk of a sealing failure at high rotational frequencies. The arrangement of sealing surfaces and the bearing design can be changed in a way that allows the use of different sealing principles without interfering with the bearing functionality and high mechanical tolerances.

Using the tumble disk principle in a spiral groove bearing may allow for a reduction of the requirements for the axial bearing. The axial bearing surfaces may still have to be plane but without the necessity of a plane parallelism as it is required for the stiff axial surfaces of T-shaped spiral groove bearings. Deviations from parallelism of the surfaces may be compensated by the tumbling movement of the disk.

Using the principles of a tumbling disk bearing allows a design placing the functional axial bearing surfaces inside the closed cylinder of the bushing without direct involvement of radial sealing surfaces.

The final disk at the end of the bearing which is used to close the sealing surfaces of the bushing (locking ring 206) has no more any bearing functionality and does not need to have a surface which is parallel to the axial bearing surfaces. Thus, the sealing ring can be combined with additional sealing principles like gaskets or sealing edge which usually have an impact on parallelism.

It is explicitly intended that the teaching of this invention covers any combination of the above-described embodiments.

While the invention has been illustrated and described in detail in the drawings and foregoing description, such illustration and description are to be considered illustrative or exemplary and not restrictive and it is not intended to limit the invention to the disclosed embodiments. The mere fact that certain measures are recited in mutually different dependent claims does not indicate that a combination of these measures cannot be used advantageously. Any reference signs in the claims should not be construed as limiting the scope.

In the claims, the word "comprising" does not exclude other elements or steps, and the indefinite article "a" or "an" does not exclude a plurality.

LIST OF REFERENCE SIGNS

101 Cathode assembly
103 Spiral groove bearing
104 Metal vacuum envelope
105 X-ray window
106 Motor assembly
201 Anode disk
202 Bearing shaft
203 Bushing
204 Tumble disk
205 Spacer ring
206 Locking ring (axial bearing side)
207 Locking ring (radial bearing side)
208 Rotor
2011 Radial bearing surfaces
2012 Axial bearing surfaces
405 Thrust disks
406 Radial sealings with lubricant impact
407 Radial sealing without lubricant impact
408 Channel
409 Channel
500 Rotary-anode X-ray tube
601 Radial sealing section
602 Radial sealing section
603 Gasket
604 Gasket
605 Bushing element
607 First thrust disk
608 Second thrust disk
609 Cylindrical bearing surface
610 Cylindrical bearing surface
611 Section facing tumble disk arrangement
612 Cylindrical subsection of the bushing
613 Cylindrical subsection of the bushing
614 Geometrical step inside the bushing
615 Geometrical step inside the bushing
700 Examination apparatus
701 Control unit
702 Detector
703 Mechanical connection

The invention claimed is:

1. A rotary-anode X-ray tube, comprising: a sleeve bearing with an inner bearing member and an outer bearing member having axial bearing surfaces adapted for taking up axial bearing forces and radial bearing surfaces adapted for taking up radial bearing forces; wherein the outer bearing member encloses the inner bearing member and comprises at least one radial sealing section; wherein none of the radial sealing sections has a functional relation to the axial bearing surfaces, wherein the inner bearing member comprises a tumble disc arrangement with the axial bearing surfaces for taking up the axial bearing forces.

2. The rotary-anode X-ray tube of claim 1, wherein the outer bearing member comprises a bushing element with a cylindrical inner radial bearing surface and a section facing the tumble disc arrangement of the inner bearing member.

3. The rotary-anode X-ray tube of claim 2, further comprising: a first locking ring abutting the bushing element at one end for sealing one end of the sleeve bearing; a second locking ring abutting the bushing element at another end for sealing another end of the sleeve bearing; wherein the radial sealing sections are located between the first locking ring and the bushing element and between the second locking ring and the bushing element.

4. The rotary-anode X-ray tube of claim 1, wherein a radial sealing section of the at least one radial sealing sections comprises a gasket or a sealing edge.

5. The rotary-anode X-ray tube of claim 2, further comprising: a first thrust disc and a second thrust disc; wherein the first and the second thrust discs provide for the axial bearing surfaces and are placed inside the bushing element.

6. The rotary-anode X-ray tube of claim 5, wherein the section facing the tumble disc arrangement of the inner bearing member of the bushing element has a first cylindrical sub-section with a first diameter adapted for receiving the first thrust disc and a second cylindrical sub-section with a second diameter adapted for receiving the second thrust disc; wherein the first diameter is bigger than the second diameter which is bigger than a third diameter of the cylindrical inner radial bearing surface.

7. The rotary-anode X-ray tube of claim 1, wherein the tumble disc arrangement and the radial bearing surfaces have the same diameter.

8. An examination apparatus for examination of an object of interest, the examination apparatus comprising: the rotary-anode X-ray tube of claim 1.

9. The examination apparatus of claim 8, adapted as a medical imaging apparatus.

* * * * *